US009315963B2

(12) United States Patent
Smith

(10) Patent No.: US 9,315,963 B2
(45) Date of Patent: Apr. 19, 2016

(54) OFFSHORE ATOLL SYSTEM AND RELATED METHODS OF USE

(71) Applicant: Deep Down, Inc., Channelview, TX (US)

(72) Inventor: Ron Smith, Houston, TX (US)

(73) Assignee: Deep Down, Inc., Channelview, TX (US)

( * ) Notice: Subject to any disclaimer, the term of this patent is extended or adjusted under 35 U.S.C. 154(b) by 0 days.

(21) Appl. No.: 14/642,176

(22) Filed: Mar. 9, 2015

(65) Prior Publication Data

US 2015/0176236 A1 Jun. 25, 2015

Related U.S. Application Data

(63) Continuation of application No. 13/436,157, filed on Mar. 30, 2012, now Pat. No. 8,974,143.

(60) Provisional application No. 61/470,007, filed on Mar. 31, 2011.

(51) Int. Cl.

| | |
|---|---|
| ***E02B 15/06*** | (2006.01) |
| ***E02B 15/04*** | (2006.01) |
| ***E02B 15/08*** | (2006.01) |
| ***E02B 3/04*** | (2006.01) |
| ***E02B 3/06*** | (2006.01) |

(52) U.S. Cl.

CPC ..... *E02B 15/045* (2013.01); *E02B 3/04* (2013.01); *E02B 3/046* (2013.01); *E02B 3/062* (2013.01); *E02B 15/046* (2013.01); *E02B 15/048* (2013.01); *E02B 15/06* (2013.01); *E02B 15/0807* (2013.01); *E02B 15/0814* (2013.01); *E02B 15/0885* (2013.01)

(58) Field of Classification Search

USPC ..... 405/26, 27, 60, 63, 64, 70; 201/242.3

See application file for complete search history.

(56) References Cited

U.S. PATENT DOCUMENTS

| | | | | |
|---|---|---|---|---|
| 3,595,026 | A * | 7/1971 | Scholl | E02B 3/062 405/26 |
| 3,691,774 | A | 9/1972 | Hard | |
| 3,803,848 | A | 4/1974 | Van't Hof | |
| 4,430,955 | A | 2/1984 | Jaffrennou et al. | |
| 4,752,393 | A | 6/1988 | Meyers | |
| 4,988,438 | A | 1/1991 | Eddleman | |
| 5,160,432 | A | 11/1992 | Gattuso | |
| 5,871,305 | A | 2/1999 | Allen | |
| 6,854,927 | B2 * | 2/2005 | Miyazaki | E02B 15/08 405/63 |

(Continued)

OTHER PUBLICATIONS

Office Action in related U.S. Appl. No. 13/436,157, mailed Oct. 25, 2013 (20 pages).

(Continued)

*Primary Examiner* — Benjamin Fiorello
*Assistant Examiner* — Kyle Armstrong
(74) *Attorney, Agent, or Firm* — Osha Liang LLP

(57) ABSTRACT

An offshore atoll system includes a continuous barrier, the continuous barrier having one or more modular sections coupled together, wherein each of the one or more modular sections have at least one concave surface positioned at a sea surface. The continuous barrier also includes one or more thrusters disposed along a length thereof. The continuous barrier is provided to reduce a magnitude of incoming waves on at least one side of the continuous barrier.

18 Claims, 7 Drawing Sheets

(56) References Cited

U.S. PATENT DOCUMENTS

| | | | | |
|---|---|---|---|---|
| 2011/0042323 | A1 | 2/2011 | Sullivan, II | |
| 2013/0058720 | A1 * | 3/2013 | Marcello | E02B 3/102 405/21 |

OTHER PUBLICATIONS

Office Action in related U.S. Appl. No. 13/436,157, mailed Jul. 14, 2014 (25 pages).

* cited by examiner

OFFSHORE ATOLL SYSTEM AND RELATED METHODS OF USE

CROSS-REFERENCE TO RELATED APPLICATIONS

This Application is a Continuation of application Ser. No. 13/436,157 filed on Mar. 30, 2012. Application Ser. No. 13/436,157 claims the benefit of U.S. Provisional Application 61/470,007 filed on Mar. 31, 2011. The '157 Application and the '007 Application are incorporated by reference in their entireties.

BACKGROUND

1. Field of the Disclosure

Embodiments disclosed herein relate generally to offshore containment systems.

In particular, embodiments disclosed herein relate to an offshore atoll system that may be deployed to provide sore manageable working conditions for subsea operations as well as spill containment and clean-up.

2. Background Art

Inclement weather may affect subsea recovery operations due to an inability to safely launch and recover a remotely operated vehicle ("ROV") or to lift various subsea packages in and out of the water with cranes on a rig. For example, rough seas and high winds may cause loads to swing excessively, which may prevent personnel from safely working on deck. Further, a heliport on the rig may be affected by swells and make conditions unsafe to land a helicopter on the rig. As such, until the inclement weather passes, the oilfield must shut down, which may be very costly.

In addition, in the event of a spill, containment systems are typically stored and deployed from a beach, which can take a large amount of time before the containment system is able to effectively contain the spill. Further, containment efforts may often be frustrated further by inclement weather as the spilled oil may easily evade the containment system.

Accordingly, there exists a need for a system capable of fast deployment that provides the ability to work in rougher seas for various types of offshore operations, including subsea operations and spill containment.

SUMMARY OF THE DISCLOSURE

In one aspect, embodiments disclosed herein relate to an offshore atoll system including a continuous harrier positioned at a sea surface and configured to reduce a magnitude of incoming waves on at least one side of the continuous barrier.

In other aspects, embodiments disclosed herein relate to an offshore atoll system including one or more modular sections coupled together to form a continuous barrier on a sea surface. The modular sections include an upper bulkhead extending above the sea surface, a passive skimming system having plurality of slots positioned at about the sea surface to allow a mixed liquid from a containment area to enter an inner chamber of the modular sections, a return outlet configured to return a first liquid from the internal fluid storage volume to the containment area, an offloading outlet configured to transport a second liquid from the internal fluid storage volume to a vessel, and a skirt extending downward from the upper bulkhead below the sea surface.

In other aspects, embodiments disclosed herein relate to a method of providing an offshore working area, the method including coupling one or more buoyant modular sections together and forming a continuous barrier and providing one or more wave deflecting surfaces on the continuous barrier, wherein the wave breaking surfaces are configured to reduce a magnitude of incoming waves colliding with the wave breaking surfaces.

Other aspects and advantages of the invention will be apparent from the following description and the appended claims.

DETAILED DESCRIPTION

Figure 1A:
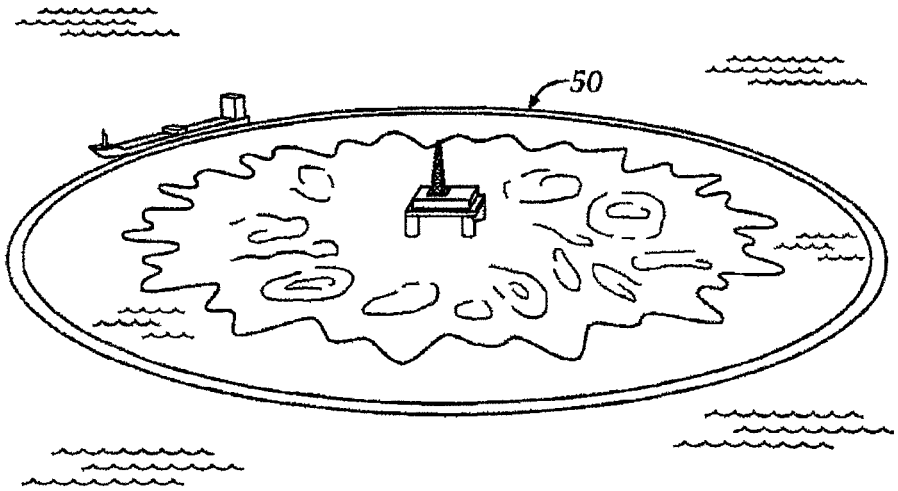
FIG. 1A shows an aerial view of an atoll system in a containment mode in accordance with one or more embodiments of the present disclosure.
Figure 1B:
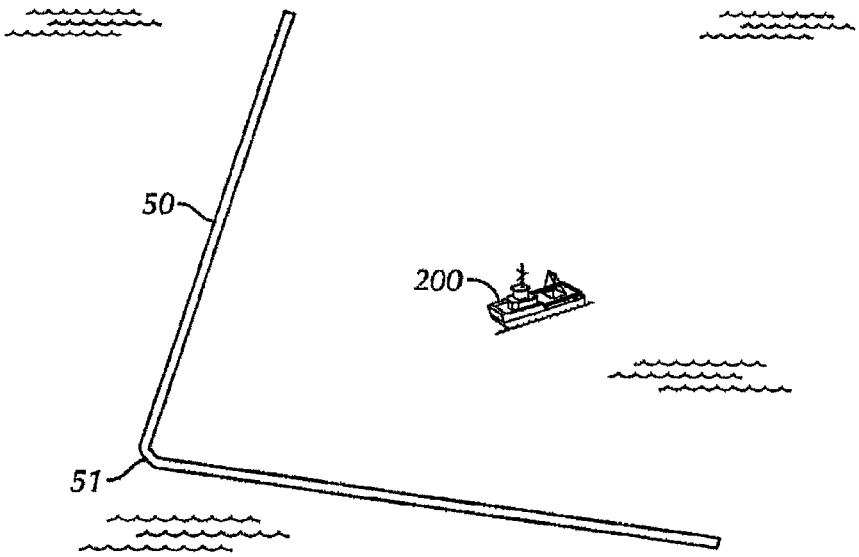
FIG. 1B shows an aerial view of an atoll system in a wave breaking mode in accordance with one or more embodiments of the present disclosure.
Figure 1C:
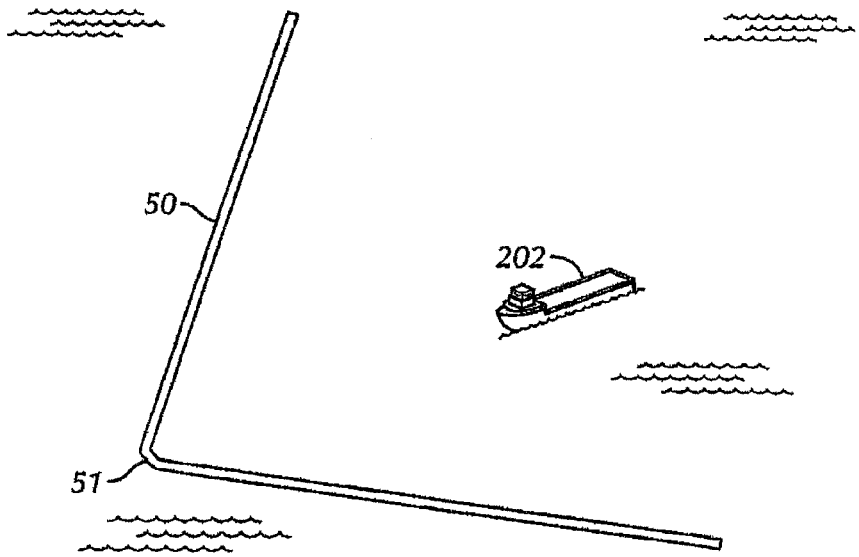
FIG. 1C shows an aerial view of a larger atoll system in a wave breaking mode in accordance with one or more embodiments of the present disclosure.
Figure 1D:
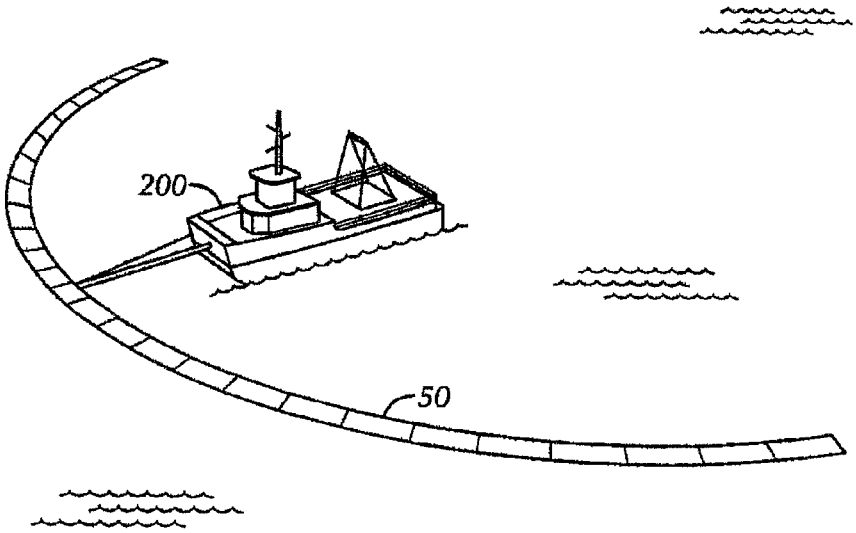
FIG. 1D shows an aerial view of a smaller atoll system in a wave breaking mode in accordance with one or more embodiments of the present disclosure.
Figure 1E:
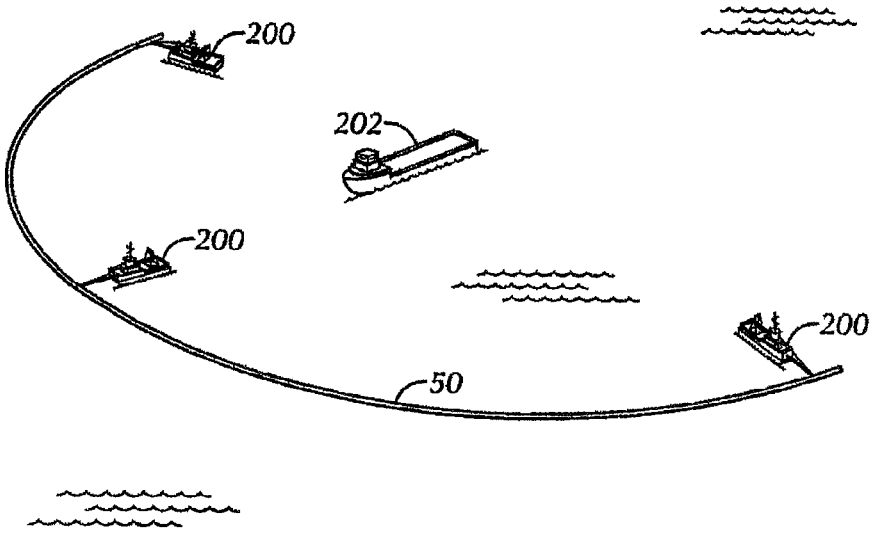
FIG. 1E shows an aerial view of a larger atoll system in a wave breaking mode and having a larger vessel and multiple smaller vessels therebehind in accordance with one or more embodiments of the present disclosure.
Figure 2A:
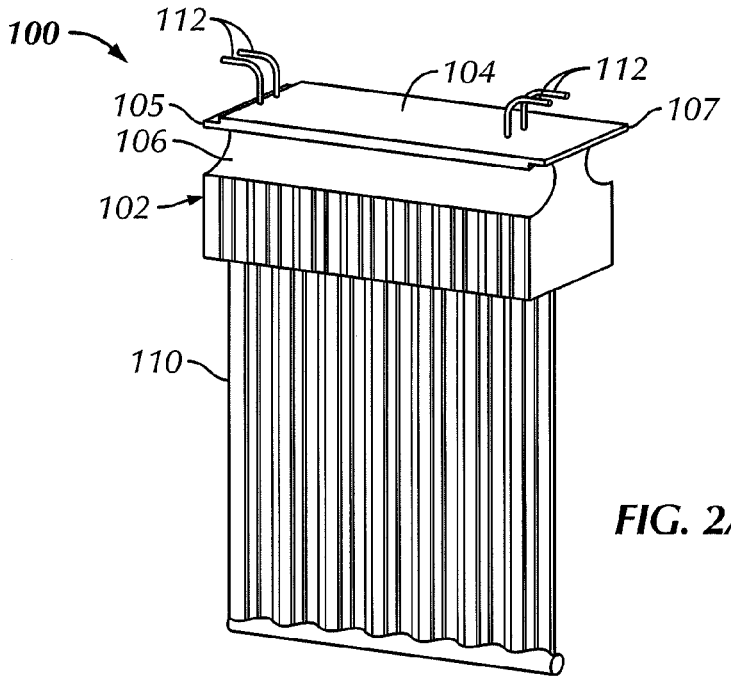
FIGS. 2A-2D show various views of an individual modular section of an atoll system in accordance with one or more embodiments of the present disclosure.
Figure 2C:
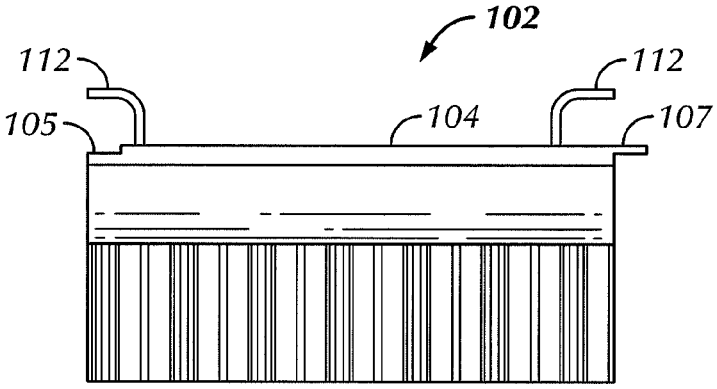
Figure 2B:
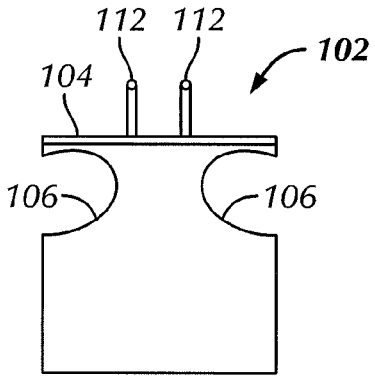
Figure 2D:
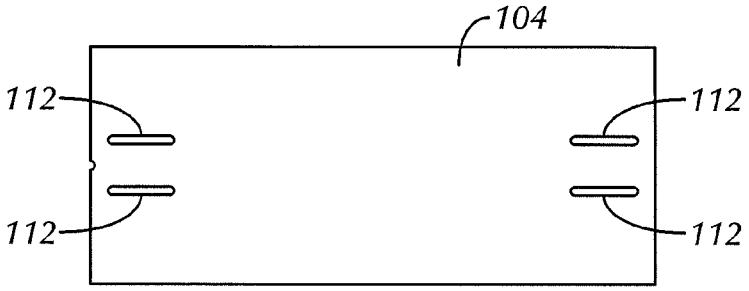

In one aspect, embodiments disclosed herein relate to an atoll system that is capable of rapid offshore deployment and which provides more manageable working conditions within. Referring initially to FIGS. 1A-1E, aerial views of various configurations of the atoll system in accordance with one or more embodiments of the present disclosure are shown. FIG. 1A illustrates an atoll system 50 in a "containment mode" in which the atoll system may be towed to a spill location and positioned to surround the drilling or production platform from were the spill originated. FIG. 1B illustrates an atoll system 50 in a "wave breaking mode" in which the atoll system reduces the magnitude of incoming waves and creates an artificial harbor behind it to allow a smaller vessel 200 to operate in higher seas. FIG. 1C illustrates a larger version of the atoll system 50 in wave breaking mode in which a larger vessel 202 may operate behind the atoll system in rougher seas. FIG. 1D illustrates an alternate embodiment in which a smaller "personal" atoll system 50 is attached to a smaller vessel 200 and extends in front of the smaller vessel to break the waves and provide calmer seas therebehind for the smaller vessel to work in. Finally, FIG. 1E illustrates a larger atoll system 50 behind which a larger vessel 202 and multiple smaller vessels 200 may work.

Those skilled in the art will appreciate that while a number of various atoll system configurations are illustrated, any number of various arrangements of the atoll system may be employed, from varying a size of the atoll system to the number of vessels working therein. In addition, in certain embodiments, the atoll system may be configured to provide protection to a vessel or other floating device from other vessels'. For example, when at a foreign dock, the atoll system may provide a physical barrier to prevent other vessels, possibly "unfriendly vessels, from coming near the protected vessels.

The atoll system 50 disclosed herein is a modular atoll system that may be towed offshore by a supply vessel, or be transported under its own power and steered and operated remotely from the beach, chase boat, or other offshore platform. It may also be transported offshore by a dedicated support vessel acting like a mobile dry dock where the modules are folded up in shorter sections (e.g., 100 feet sections). Once in the field, the atoll system is configured to be deployed using a dynamic positioning ("DP") algorithm. If a wave breaking mode is desired, such that a vessel can work behind the atoll system, a common shape into which the atoll system may be deployed is a "V" shape, as shown in FIG. 113. Those skilled in the art will appreciate, however, that any algorithm may be used to command the atoll system to form other shapes, including, but not limited to, semi-circular, circular, and quadrangular. The DP algorithm is further configured to allow the atoll system to maintain position and divert and knock down incoming waves, thus forming a calm region, or artificial harbor, inside the atoll system. This allows smaller vessels and even larger vessels to operate in rougher seas and higher currents. In certain embodiments, a proximity system, which includes proximity sensors, may be incorporated to allow the atoll system to maintain a certain distance and heading out in front of the protected vessels so the vessels may move around the field while working and still be protected. Further, in other embodiments, in the event of an environmental situation (e.g., a spill), a first end of the atoll may be instructed to seek out and couple with a second end, thus forming a complete circle and containing the spill.

Referring to FIGS. 2A-2D, the atoll system 50 may include individual modular sections 100 coupled together to form a continuous length. In certain embodiments, the modular sections 100 may be molded high density polypropylene ("HOPE") shells, commercially available from, for example, flotation Technologies, located in Houston, Tex. The modular sections 100 may be configured in various sizes and lengths as required. In certain embodiments, for example, the modular sections may be about five feet high, the feet wide, and fourteen feet long. An upper bulkhead 102 of the modular sections 100 may be formed having a flat top 104 and one or more wave deflecting surfaces, including, but not limited to, one or more concave sections 106. In certain embodiments, the upper bulkhead 102 may include only a single concave surface facing incoming waves. Likewise, in alternate embodiments, other angled surfaces or wave breaking configurations may be used.

The modular sections 100 further include a lower skirt 110 that is connected to and extends downward from the upper bulkhead 102. The lower skirt 110 may be steel, HDPE, or other materials known to those skilled in the art. In certain embodiments, the lower skirt 110 may have a corrugated skin outer surface, which is configured to deflect waves and reduce a magnitude of incoming waves. In certain embodiments, the lower skirt 110 may extend downward about twenty feet (or more or less depending on the water depth). In other embodiments, the lower skirt 110 may include an additional flexible skirt (not shown) attached to the bottom thereof which is configured to extend downward to a seafloor in shallower water for beach protection. The flexible skirt may be a metallic material or other materials known to those skilled in the art.

Figure 3:
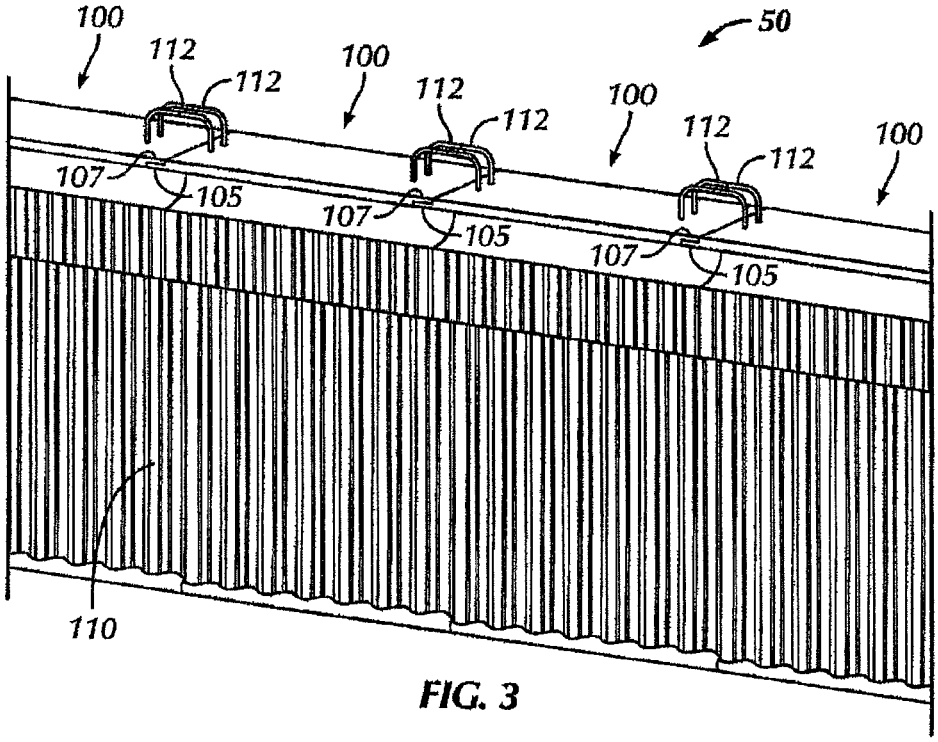
FIG. 3 shows a perspective view of multiple modular sections of an atoll system coupled together in accordance with one or more embodiments of the present disclosure.

As shown in FIG. 3, the modular sections 100 are configured to be coupled end to end to form a continuous barrier forming the atoll system 50. A first end of the modular section 100 may have a step 105 while a second or opposite end of the modular section 100 may have an overhang 107. The step 105 is configured to engage an overhang of an adjacent modular section, while the overhang 107 is configured to engage a step of an adjacent modular section. The modular sections 100 may be coupled together with pins (not shown) or any other fasteners known to those skilled in the art, including, but not limited to, latches, bolts, etc.

Figure 4:
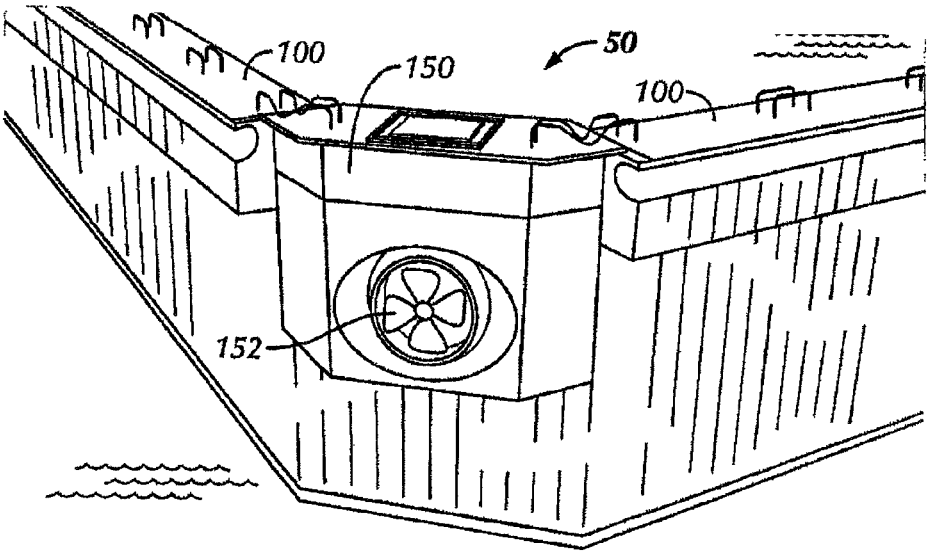
FIG. 4 shows a dynamic positioning node with a thruster of an atoll system in accordance with one or more embodiments of the present disclosure.

The atoll system further includes one or more DP nodes or pods 150 coupled to the atoll system and arranged along a length thereof for transporting the atoll system as required, one of which is shown in FIG. 4. The DP nodes 150 each may contain a thruster 152 (e.g., a propeller device) in each node 150 and fuel tanks (not shown) (storing diesel, gas, or alternative fuels) in sections adjacent to the nodes. In certain embodiments, azimuth thrusters may be used in the DP nodes 150. Azimuth thrusters may be arranged having a propeller placed in pods and that can be rotated in any horizontal direction for steering purposes. Azimuth thrusters may be fixed or retractable and may be configured having either controlled or fixed pitch propellers Fixed pitch propellers may generally be used for smaller vessels, while retractable thrusters may be used for heavier structures.

In certain embodiments, the thrusters in the DP nodes or pods may be connected to a separate motor by means of a mechanical system (i.e., gearing). The motor may be diesel, gas, or electric powered. In other embodiments, the motor may be powered by an alternative fuel. An electrical transmission thruster may be located, in the DP node or pod and may be connected to thrust without the use of a gearing mechanism. The power required by the electric motor may be derived from the main power system (i.e., a diesel engine or gas turbine). These thrusters may be configured to have a horizontal range of motion of about 360 degrees, thus providing precise maneuverability. In certain embodiments, thrusters may be azimuth thrusters commercially available from for example. Thrustmaster of Texas, located in Houston, Tex. Still further, those skilled in the art will appreciate that any number of different types of propulsion mechanisms may be used in accordance with embodiments disclosed herein, including, but not limited to, tunnel thrusters, retractable thrusters, underwater mount thrusters, propulsion units, and fixed podded drives.

Alternatively, the nodes may contain a generator in certain nodes and/or pumps in other nodes. The thrusters may be integrated with an intelligent dynamic positioned network in communication with a laptop or other wireless control device for positioning of the atoll system at particular locations. The atoll system may include a harness of other wiring arrangements which connect positioning controls with the DP nodes. The atoll system may include a number of different types of sensors such as motion reference units, wind sensors, and draught sensors which give feedback to the DP nodes and the thrusters. As such, the thrusters may be adjusted to maintain the atoll system positions based on positioning information received from the sensors. Different numbers of DP nodes may be used depending on the length of the atoll system. For example, three DP nodes with thrusters may be used for a 1,000 foot long atoll system. In another example, five DP nodes with thrusters may be used for a 5,000 foot long atoll system. DP nodes may be spaced evenly or unevenly along a length of the atoll system. As shown in FIG. 4, in certain embodiments, a main DP node 150 with a thruster 152 may be located at a forward point or "bow" 51 of the atoll system 50 in a wave breaking mode (shown in FIG. 1B).

Figure 5:
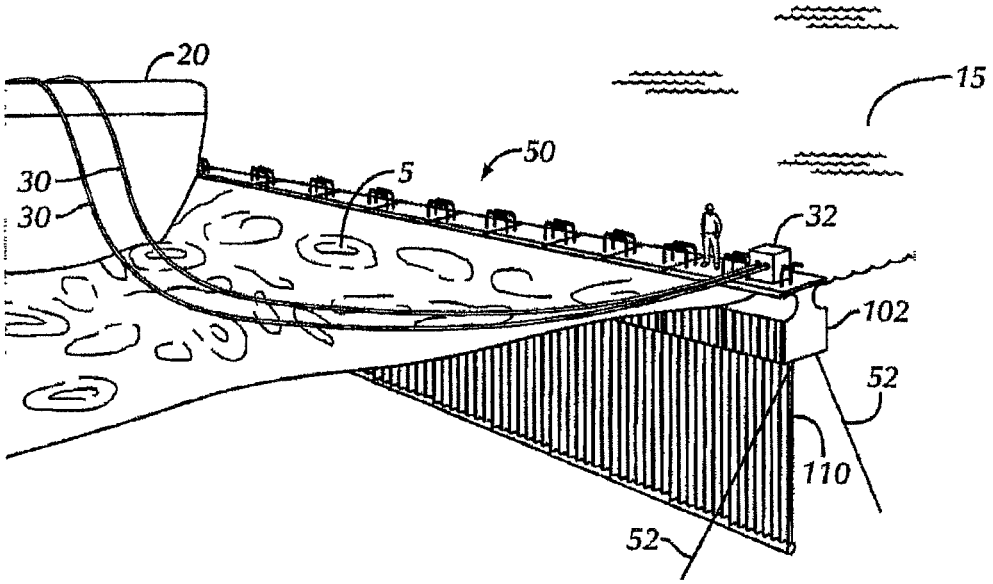
FIG. 5 shows an atoll system in containment mode in accordance with one or more embodiments of the present disclosure.

Referring now to FIG. 5, the atoll system 50 is shown in a containment mode separating a containment area 5, in which oil or other liquid has spilled and contaminated the water, from an uncontaminated area 15. As shown, in shallower water (particularly near beaches) the skirt 110 of the atoll system 50 may extend down to the seafloor to prevent oil from reaching the beaches. Also, in shallower water the atoll system 50 may be tied down using mooring lines 52 to maintain its position.

Figure 6:
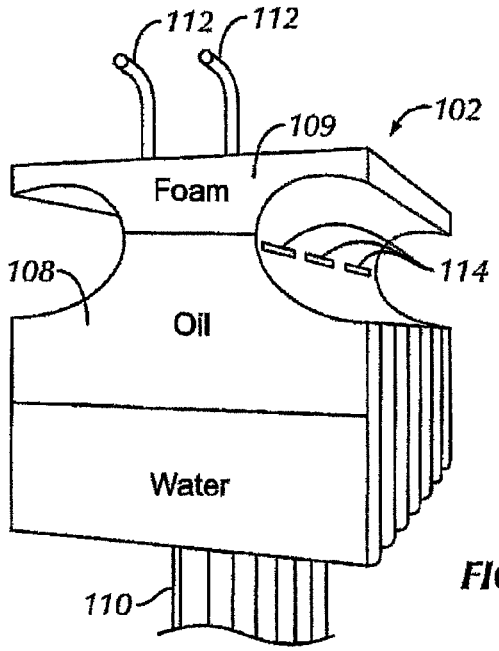
FIG. 6 shows a cross-sectional view of an inner chamber of a modular section of an atoll system in accordance with one or more embodiments of the present disclosure.

Now referring to FIGS. 5 and 6 together, the atoll system 50 may further include a skimming and storage system for surface oil spill removal from a containment area 5. The skimming system may be either passive or active. Each of the modular sections 100 may be formed having an inner chamber 108 therein for fluid storage. An upper portion 109 of the upper bulkhead 102 may be filled with a foam or similar buoyant material such that when the inner chamber 108 is filled with seawater or oil, the modular section 100 still floats and remains stable. Further, the modular sections 100 include one or more flexible hoses 112, which are configured to connect with flexible hoses 112 on adjacent modular sections 100 to provide fluid communication between the modular sections 100.

In operation, a mixture of oil and water from the spill area may enter the inner chambers 108 of the modular sections 100 through multiple slots 114. The slots may be spaced evenly along only a "dirty" side of the sections, i.e., the side facing the containment or spill area. Once the oil/water mixture is in the inner chamber 108 and has segregated (due to different fluid densities), centrifugal pumps (not shown) may pull the separated water from the bottom of the inner chamber 108 and return the water to the containment area, while the oil remains in the inner chamber 108. This high flow replacement of fluid causes suction through the multiple slots 114 and more oil/water mixture may enter the inner chamber 108. Eventually, the inner chamber 108 is filled with only oil removed from the containment area, while the separated water has been pumped back into the containment area. In certain embodiments, a 5,000 foot long atoll system (i.e., multiple modular sections 100 coupled together to form the length) may store up to about 25,000 barrels of oil while awaiting arrival of an offloading tanker.

In certain embodiments, the atoll system may include a circulation system (not shown) to facilitate the oil and water separation in the inner chambers 108. in the event that additional separation of the oil and water is required, additional baffles and/or separate plates within the inner chamber 108 to facilitate more separation may be included. In certain embodiments, a tank gauging system may be included to monitor the presence of oil and water, or a mixture thereof, in the chambers 108. The gauging system may be configured to automatically control the entry of new fluid through an actuated inlet and outlet valves to optimize the circulation of fluid that is being separated.

In reference to FIG. 5, offloading of the oil stored within the modular sections 100 of the atoll system 50 may be performed either in parallel while the skimming system is collecting oil from the containment area 5 or after the spill has been contained. FIG. 5 also provides a representation of the atoll system's 50 separation of the containment area 5 from "uncontaminated water" 15 where the spill is prevented from flowing. A second set of hoses 30 extending from an offloading node 32 on the atoll system 50 allows a vessel 20 to come alongside the atoll system 50 and offload the oil stored in the atoll system 50. An offloading pipe or outlet (not shown) extends just into the upper portion of the inner chamber 108 of the section 100 to such or remove oil from the upper volume instead of the water. During offloading of the oil, if water begins to be offloaded, then the offloading stops until enough oil is accumulated in the top portion of the inner chamber 108 to retrieve.

In certain embodiments, a 1,000 foot long atoll system comprised of modular sections 100 that are about five feet high by about five feet vide by about fourteen feet long may be connected and store about 5,000 barrels for offloading. Once the supply boat or tanker is full and leaves, the skimming system continues to work until the next vessel is connected. In alternate embodiments, the size of the modular sections 100 may be increased for increased storage capacity. For example, larger modular sections 100 may be about eight feet tall, about eight feet wide, and about thirty feet long, and have one or more additional concave surfaces (i.e., wave stopping section) added on top. In certain embodiments, multiple concave surfaces may be stacked on top of each other for higher swells. Those skilled in the art will appreciate any number of arrangements of concave surfaces. Thus, a 5,000 foot long atoll system having modular sections of this larger size may store up to about 57,000 barrels. Those skilled in the art will appreciate that the storage capacity of the atoll system may be varied as required by increasing the various dimensions of the modular sections in accordance with one or more embodiments disclosed herein. The atoll system 50 may work in conjunction with large skimming vessels where modular sections 100 may be attached to each end of the vessel allowing the DP nodes to form a funnel shape and help oil being guided into the skimming ships. The storage offloading hoses can be attached to the skimming vessel to offload the skimmed oil in parallel making it a safer and more efficient operation.

Methods relating to use of the atoll system described in accordance with embodiments disclosed herein provide that the atoll system may remain in the field under its own power and provide protection from the sea for vessels located within a containment area or artificial harbor created by the atoll system. Collision of incoming waves with concave surfaces of the atoll system cause the waves to be dampened, while collision of incoming waves with 45 degree surfaces of the corrugated hull and skirt cause the waves to be reflected back at a 45 degree angle back into more incoming waves. In alternate embodiments, other angled surfaces may be arranged on the corrugated hull and skirt. For example, the angled surfaces may range from about 5 degrees to about 85 degrees. Reflection of the incoming waves may emulate the angled surface from which the wave is reflected. Thus, magnitudes of the incoming waves are reduced, leaving a calm area on a protected side of the atoll system. The atoll system may include heave compensation devices to allow it to float up and down with the swell, thus reducing the size requirement of the atoll above water section. The atoll system is configured to be rapidly transported to (either towed or transported under its own power) and deployed in the field, thereby providing a fast response time to environmental emergencies that may arise offshore.

In certain embodiments, the atoll system may be configured to operate in more frigid environments in which ice may trap spilled oil that has risen to a sea surface. An atoll comprised of modular sections absent any upper foam filling may be inserted with hydraulic or electrical powered thrusters through a hole in the ice. The surface control unit skid may include contain a generator to provide power to the thrusters. An acoustical reference system may be used for positioning. When the atoll system is inserted into the ice, an end of the atoll system may be at or near the surface hole in the ice, and through which the entire atoll system may be supported. Once the atoll system is in the desired position and surrounding the oil spill to capture the rising and moving oil, air is pumped into the ballast cavities (i.e., inner chambers) once occupied with the foam until the atoll system is more buoyant than the water, and thus, is pressed against the bottom of the ice. In certain configurations, the flat top of the modular sections of the atoll system may have a plurality of teeth formed thereon which would grab and seal against the bottom of the ice. The thruster nodes may also contain hydraulic operated cylinder spikes which would drive the steel spikes up into the ice anchoring and holding the atoll system in place so the thrusters can be shut down.

With the atoll system pinned in place under the ice, the oil can be offloaded as in the standard configuration. Methanol may be injected from a separate line in the control circuit to prevent freezing along with other inhibitor fluids if necessary. The entire process may be reversed and the system recovered from beneath the ice, beginning with retracting the spikes, flooding the ballast tanks and forming the atoll into a straight line and recovering it one section at a time.

In alternate embodiments, the atoll system may be configured to contain and recover near-surface and/or semi-buoyant emulsified oil. The modular sections 100 (FIG. 2A) may be positioned vertically and would have a top chamber acting as a ballast portion. A DP support vessel (which may include equipment with power to feed the control umbilical and operate the semi-sub ballast control and thruster control and equipped with ROV) will control the movement and depth of the semi-sub atoll and to any depth and monitored by the ROV and sensors. The remaining sections may have oil storage in sixteen of the twenty feet vertical section, in certain embodiments holding about 114,000 barrels of oil in a 5,000 foot long pinned section. One or more DP nodes with thrusters are configured to maintain the modular section at the necessary position. In this embodiment, skimming slots may be arranged such that only the emulsified oil spills over into the modular sections (without the water). The collected oil may then be offloaded to a waiting vessel. Those skilled in the art will be familiar with standard skimming methods used in accordance with embodiments of the present disclosure.

Figure 7A:
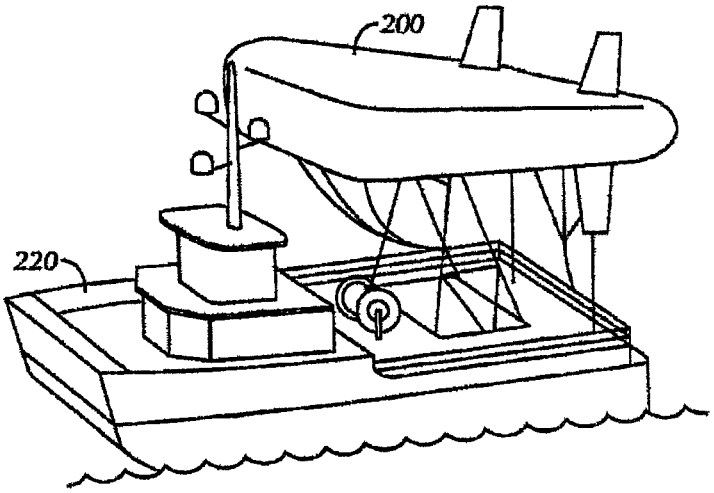
FIGS. 7A and 7B show a small vessel and blimp before and after deployment in accordance with one or more embodiments of the present disclosure.
Figure 7B:
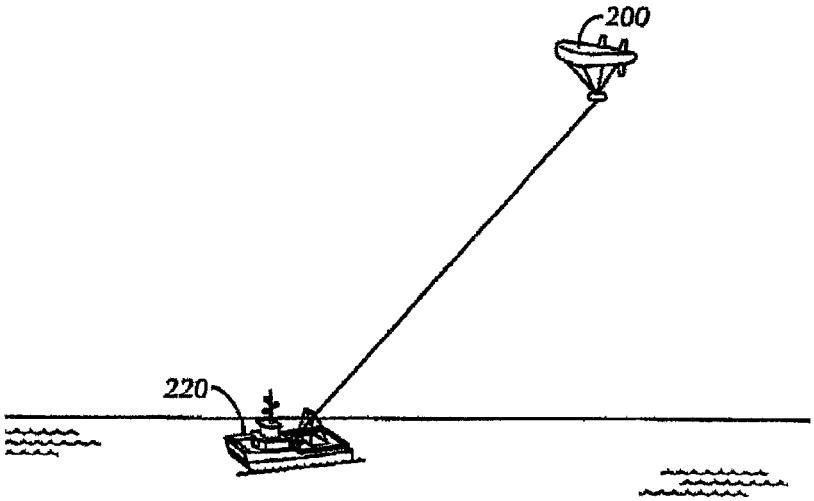

In further embodiments, the atoll system may be used in conjunction with a blimp having a thermal imaging camera used in spotting small amounts of oil in the water even at night time. Recognition software may be used, when platforms or vessels may be monitored remotely allowing the software to recognize the presence of oil and send out alarms. As such oil in the water at night may be recognized before the sunrise comes up and a spill has had a chance to spread. As shown in FIGS. 7A and 78, a blimp 200 or other aerial floating device may be tethered to a small floating vessel 220, which would allow monitoring and tracking of presence of oil in the water. For example, as shown in FIG. 78, when the blimp 200 reaches a maximum altitude, the blimp may have a fifty mile or more radius view for monitoring and tracking the presence of oil. In addition, a remote operated vehicle ("ROV") (not shown) may be attached to the smaller floating vessel 220 such that the ROV may be deployed simultaneously with the blimp 200 to provide below surface monitoring along the same area. The tethered and unmanned blimp 200 may allow operations in up to 70 knot winds and recovers to the vessel allowing the vessel to stay in the field and continue working 24 hours a day. The ROV can perform normal ROV duties at the same time.

Advantageously, embodiments of the present disclosure provide a rapid deploy atoll system for containment of offshore oil spills. An atoll system may quickly surround a drilling or production system and maintain its position and shape as it minimizes sea conditions within, thereby allowing a vessel to work a in calmer, safer environment. In the event of an environmental spill the atoll system is already deployed to begin capturing oil immediately until vessels arrive to connect to and pump off the oil. The recovered oil may still be sold and thus, is not wasted nor left to harm the environment. Further, the atoll system may easily be transported from operating in one area to another area, either under its own power or in tow. Finally, the atoll system may remain in the field offshore and does not require deployment from a beach. Due to the rapid deployment and oil recovery abilities, the atoll system in accordance with one or more embodiments of the present disclosure may reduce future environmental cleanup costs and harms in the event of a spill.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. An offshore atoll system comprising:

a continuous barrier, the continuous barrier including:

one or more modular sections coupled together, wherein each of the one or more modular sections comprises:

at least one concave surface positioned at a sea surface;

a shell having an inner chamber therein; and a passive skimming system having a plurality of slots positioned about an inflection point of the at least one concave surface, wherein liquid from the sea surface is allowed to enter the inner chamber through the plurality of slots; and one or more thrusters disposed along a length of the continuous barrier, wherein the continuous barrier is configured to reduce a magnitude of incoming waves on at least one side of the continuous barrier.

2. The system of claim 1, wherein each of the one or more modular sections comprises a skirt that extends downward below the sea surface.

3. The system of claim 2, wherein the shell of each of the one or more modular sections comprises a polypropylene molded shell.

4. The system of claim 3, further comprising hoses configured to provide fluid communication between the inner chambers of the one or more modular sections.

5. The system of claim 1, further comprising a circulation pump configured to pump a liquid out of the inner chamber through an outlet.

6. The system of claim 1, wherein the one or more thrusters are configured to move the continuous barrier to a specific location or a specific configuration.

7. The system of claim 6, further comprising a global positioning system, wherein the global positioning system is in-sync with the one or more thrusters.

8. The system of claim 7, wherein one of the one or more thrusters is disposed along a length of the continuous barrier and is configured to move the continuous barrier.

9. The system of claim 8, wherein the one or more thrusters is disposed at a forward end of the continuous barrier with respect to a direction of movement.

10. The system of claim 1, wherein the continuous barrier is in fluid communication with a separate vessel.

11. A method of providing an offshore working area, the method comprising:

coupling two or more buoyant modular sections together and forming a continuous barrier;

positioning at least one concave surface of the continuous barrier at a sea surface, wherein the at least one concave surface is configured to reduce a magnitude of incoming waves colliding with the at least one concave surface;

passively skimming oil from the sea surface with the buoyant modular sections of the continuous barrier by allowing liquid from the sea surface to enter into an inner chamber of the continuous barrier through a slot positioned proximate an inflection point of at least one concave surface of the continuous barrier positioned at the sea surface; and using thrusters to affect a position of the continuous barrier.

12. The method of claim 11, further comprising coupling a first end of the continuous barrier with a second end of the continuous barrier and encircling a spill.

13. The method of claim 12, further comprising storing the recovered oil in the continuous barrier, and offloading the recovered oil from the continuous barrier to a storage vessel.

14. The method of claim 11, further comprising transporting the continuous barrier to a particular offshore location.

15. The method of claim 11, further comprising communicating a position of the continuous barrier to an intelligent dynamic positioned network.

16. The method of claim 15, further comprising providing aerial and subsea surveillance to locate oil spills, and moving the continuous barrier based on the surveillance.

17. The method of claim 11, further comprising maintaining a position of the continuous barrier with the thrusters.

18. The method of claim 11, further comprising moving the continuous barrier using the one or more thrusters.

* * * * *